US006688302B2

(12) United States Patent
Henry et al.

(10) Patent No.: US 6,688,302 B2
(45) Date of Patent: Feb. 10, 2004

(54) WOOD BURNING STOVE HAVING PIVOTING BAFFLE AND METHOD

(75) Inventors: Daniel S. Henry, Kettle Falls, WA (US); Matthew Owings, Colville, WA (US); Monte Jay Weaver, Colville, WA (US); Brian L. Wallace, Colville, WA (US)

(73) Assignee: Hon Technology Inc., Muscatine, IA (US)

( * ) Notice: Subject to any disclaimer, the term of this patent is extended or adjusted under 35 U.S.C. 154(b) by 348 days.

(21) Appl. No.: 09/809,627

(22) Filed: Mar. 15, 2001

(65) Prior Publication Data

US 2001/0029943 A1 Oct. 18, 2001

Related U.S. Application Data

(60) Provisional application No. 60/189,561, filed on Mar. 15, 2000.

(51) Int. Cl.[7] ..... F24C 1/14

(52) U.S. Cl. ..... 126/77; 126/83; 126/287

(58) Field of Search ..... 126/77, 83, 73, 126/286, 290, 287, 60, 15 R, 86; 110/190

(56) References Cited

U.S. PATENT DOCUMENTS 617,805 A * 1/1899 Burns ..... 110/313
835,915 A * 11/1906 Pruitt ..... 126/293
4,154,212 A * 5/1979 Wilkinson ..... 126/77
4,319,556 A * 3/1982 Schwartz et al. ..... 126/77
4,338,913 A * 7/1982 Good ..... 126/77
4,432,335 A * 2/1984 Kilham ..... 126/60
4,458,662 A * 7/1984 Barnett ..... 126/77
4,466,419 A 8/1984 Syme
4,499,889 A 2/1985 Syme
4,510,917 A * 4/1985 Runquist ..... 126/76
4,580,546 A * 4/1986 Barnett ..... 126/58
4,582,045 A * 4/1986 Dorau et al. ..... 126/290
4,665,889 A * 5/1987 Rumens et al. ..... 126/77
4,766,876 A 8/1988 Henry et al.
5,050,579 A * 9/1991 Melton et al. ..... 126/77
5,113,843 A 5/1992 Henry et al.
5,341,794 A 8/1994 Henry et al.

* cited by examiner

*Primary Examiner*—Carl D. Price
(74) *Attorney, Agent, or Firm*—Merchant & Gould P.C.

(57) ABSTRACT

A wood burning stove is provided. The combustion chamber in which the fire occurs has a baffle plate that is moveable to direct air flow through one of two different pathways from the combustion chamber to the chimney. When in a first position, the baffle plate forces the air and smoke to move through a first pathway; when in a second position, a by-pass pathway is opened, allowing air and smoke to move through a second pathway. The stove can have a door in the front wall, or the top wall, or both walls, to provide access to the combustion chamber.

20 Claims, 9 Drawing Sheets

FIG. 5
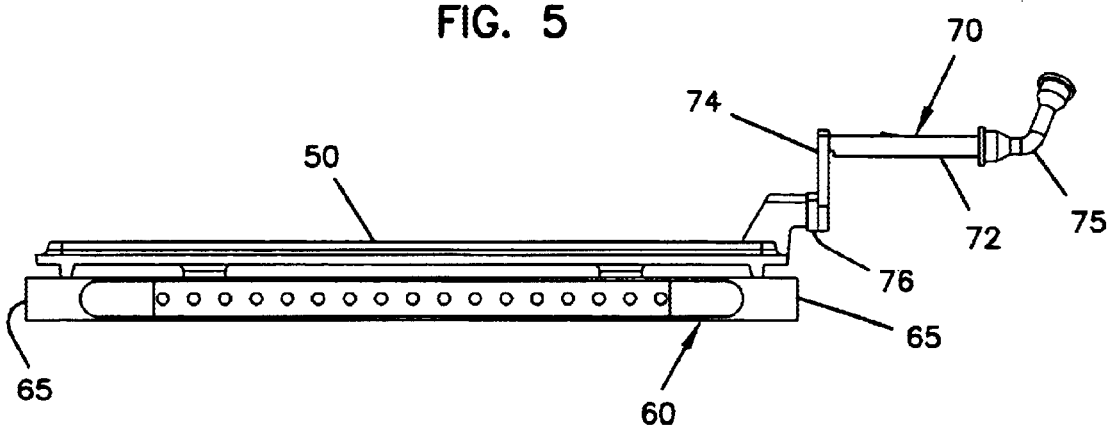
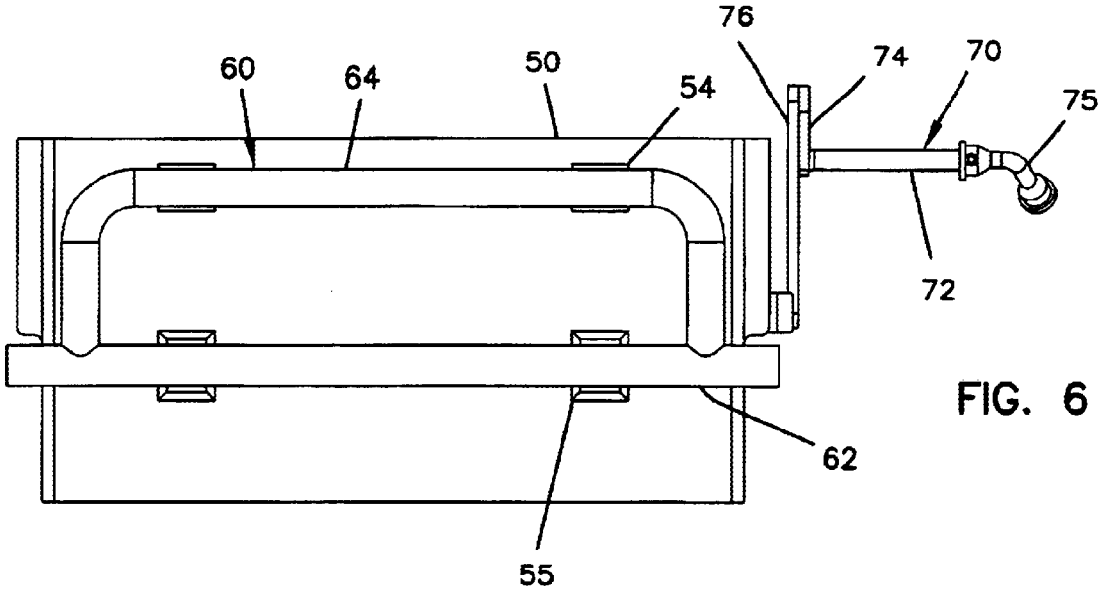
FIG. 6
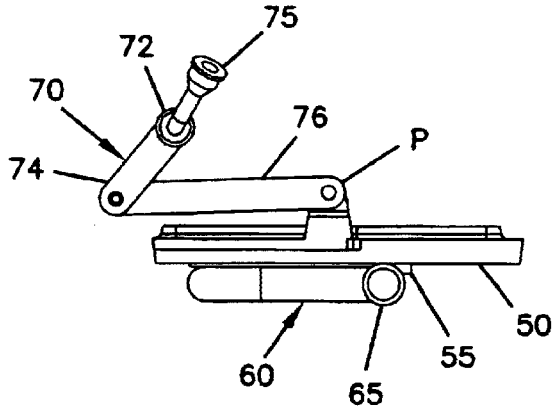
FIG. 7

WOOD BURNING STOVE HAVING PIVOTING BAFFLE AND METHOD

This application claims the benefit of Provisional application Ser. No. 60/189,561, filed Mar. 15, 2000.

FIELD OF THE DISCLOSURE

This disclosure relates generally to wood burning stoves. In particular, this disclosure relates to wood burning stoves having a baffle for regulation of air flow within the stove, and methods of using the stove.

BACKGROUND OF THE DISCLOSURE

Whether for providing heat, for purely decorative purposes, or for value enhancement, wood burning stoves have become commonplace in today's building trades for both residential and commercial applications for situations where a fireplace is not feasible or desired. In some instances, wood burning stoves have been inserted into fireplace boxes. Stoves are often preferred over open fireplaces because many wood stoves have the capability to heat large spaces efficiently. Most stoves are able to burn for extended periods of time, such as over night, without refueling or reloading, further enhancing the preference over fireplaces.

With this extended burning of wood as the primary fuel comes the challenge of providing an efficient stove that meets the Environmental Protection Agency requirements and state agency requirements for emissions, including particulate material and gases. Many wood burning stoves utilize a catalytic combustor to finalize the burning process and reduce particulate materials and gases. However, the catalytic combustors can become fouled or otherwise rendered inefficient, especially when other than selected materials are burned within the stove. Additionally, the catalytic combustors are quite expensive and must be periodically replaced.

In order to avoid using a catalytic combustor, many stove designs are aimed at providing optimum airflow within the burning chamber so that complete combustion, reduction of particulates and unburned gases, and optimum heat generation are obtained. The airflow patterns are generally created by the addition of various channels and/or baffles within the stove, in particular, within the main combustion chamber, to create a secondary combustion chamber. The use of fixed or stationary baffle plates for manipulating air flow within the combustion chamber are known for wood burning stoves, and are discussed, for example, in U.S. Pat. No. 4,766,876 (Henry et al.), U.S. Pat. No. 5,113,843 (Henry et al.), and U.S. Pat. No. 5,341,794 (Henry et al.), each of which is incorporated in its entirety herein by reference.

Depending on the design of the various channels or baffles, loading of wood into the stove can be hampered. For example, some baffles are positioned extending essentially parallel to the top surface of the stove. If the stove is a top-loading stove, that is, where wood can be inserted into the combustion chamber through the top surface of the stove, such baffles hinder access to the combustion chamber. What is desired is an improved stove design having optimal air flow patterns to increase combustion efficiency, reduce emissions, and provide easy access to the combustion chamber.

SUMMARY OF THE DISCLOSURE

The present disclosure provides a stove, in particular, a wood burning stove, that has a baffle assembly disposed within to provide optimal air flow patterns within the stove. A portion of the baffle assembly is pivotable to provide easy access to the combustion chamber to allow loading of fuel into the stove.

In particular, the stove includes a stove body which defines a stove exterior, a stove interior, and a combustion chamber disposed within the interior. A baffle plate is disposed within the combustion chamber, the baffle plate being moveable from a "closed" configuration to an "open" configuration. When in the "closed" configuration, the baffle plate is positioned substantially horizontally and is spaced apart from at least a portion of at least one wall. When in the "open" configuration, the baffle plate is positioned substantially vertically such that a by-pass pathway is created between a top access door and the combustion chamber. This allows for easy top-loading of fuel.

When in the "closed" configuration, air within the combustion chamber flows from the combustion chamber, around the baffle plate, through a passage between the baffle plate and the stove body, and out a chimney. When in the "open" configuration, a by-pass pathway is formed separate from the passage, so that air within the combustion chamber flows from the combustion chamber, through the by-pass pathway, and out the chimney. The by-pass pathway does not exist if the baffle plate is in the closed configuration. Preferably, the baffle plate is pivotable.

An air manifold is preferably present within the combustion chamber, having air flow communication with the exterior of the stove. In one embodiment, the air manifold provides a pivot point for the baffle plate. In one such embodiment, the baffle plate and the air manifold pivot together.

It will also be understood that while a wood fueled stove will be described with respect to the preferred embodiments, the disclosure is not limited to wood burning structures, but could equally apply to stove using other fuel sources. Further, while the present disclosure will be described made of sheet metal material, the disclosure is not to be limited to any particular material, but could be used with other known constructions, such as ceramic and other known materials. These and other modifications of the disclosure will be understood by those skilled in the art in view of the following description of the disclosure, with reference to specific preferred embodiments thereof.

BRIEF DESCRIPTION OF THE DRAWINGS

Referring to the figures, wherein like numerals represent like parts throughout the several views:

FIG. 5 is a front view of a portion of the baffle assembly shown in FIG. 4;

FIG. 6 is a bottom view of the portion of the baffle assembly shown in FIG. 5;

FIG. 7 is a side view of the portion of the baffle assembly shown in FIGS. 5 and 6;

DETAILED DESCRIPTION OF THE PREFERRED EMBODIMENT

Wood is generally burned in the stove, although other types of solid fuels can also be burned in the stove. The following description and figures are in reference to a wood burning stove, although it is to be understood that the function of the stove elements is not dependent on the type of fuel burned.

Figure 1:
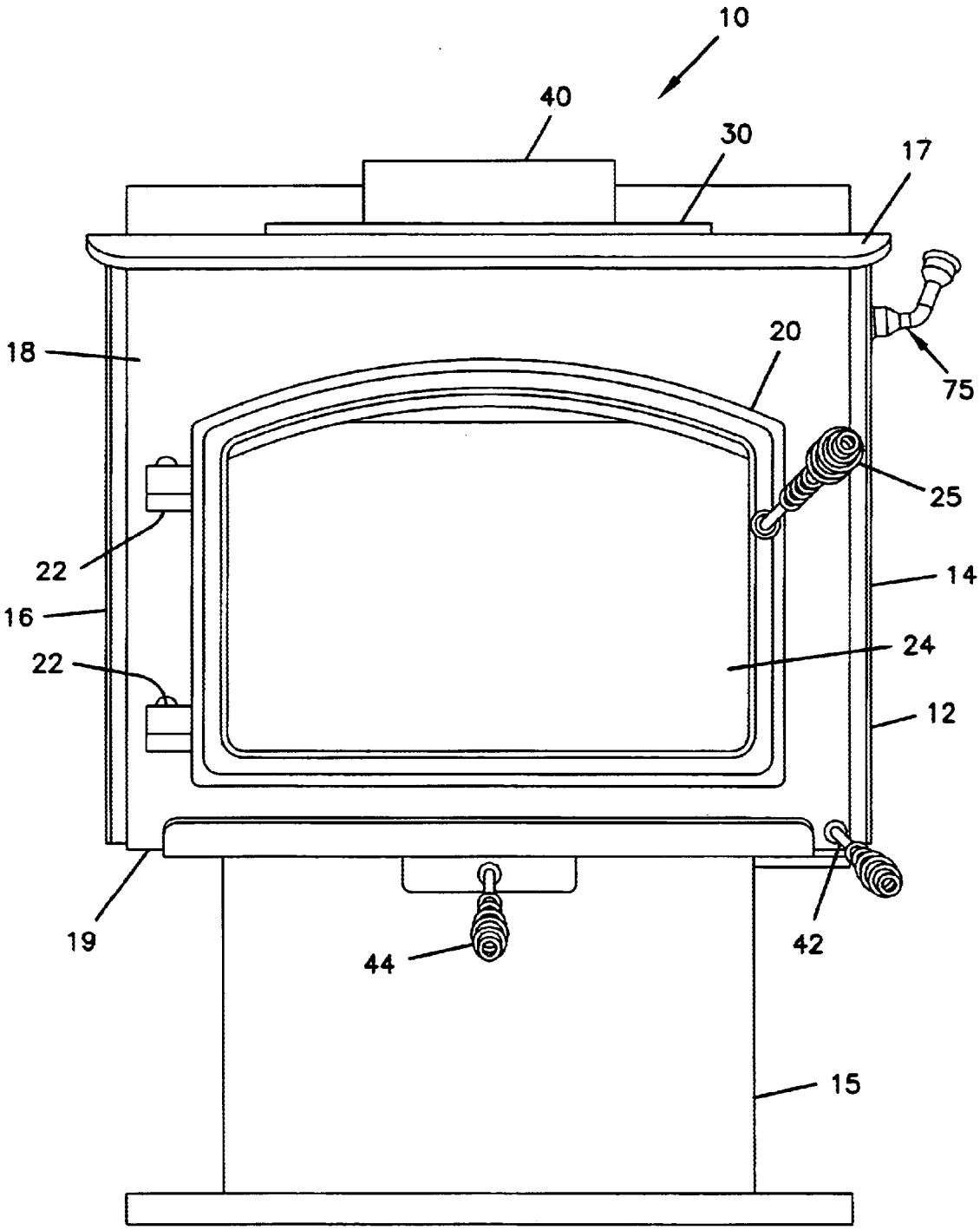
FIG. 1 is a front view of a stove of the present invention.

A stove 10 is shown in FIG. 1. Stove 10 has an enclosed body 12 defined by first side wall 14, opposite second side wall 16, a top wall 17, a front wall 18, a bottom wall 19, and a back wall, not shown. Together, these various walls define an combustion chamber within the walls. Although body 12 is described with six walls (four periphery side walls, a top wall and a bottom wall), body 12 can be any shape. In general, the body 12 is defined by a top wall, a bottom wall, and at least one side wall. Body 12 is situated on a pedestal or foot 15, which elevates body 12 above the surface on which it is supported. Typically, stove 10 is metal, such as cast iron.

A first door 20 is disposed within front wall 18, however, a door such as first door 20 can be provided in any of side walls 14, 16, front wall 18 or the back wall of stove 10. Door 20 is pivotally openable by hinges 22 attached to front wall 18. A handle 25 facilitates opening and closing of door 20. Door 20 can include a window 24 to allow viewing of the combustion chamber within the stove 10. A second door 30 is disposed within top wall 17 and is pivotally openable by hinges (not shown) attached to top wall 17. Door 30 may include a handle or other mechanism to facilitate opening and closing of door 30. Each of doors 20, 30 can be used to place fuel, such as wood logs, into the combustion chamber of stove 10.

A stack, flue or chimney 40 is provided to allow the exhaust gases generated by the burning fuel to exit the stove 10. Included in stove 10 are various air intake apertures and channels, to provide air to the interior of the combustion chamber. Handles 42, 44 can be used to manipulate the flow of intake air.

The above description of stove 10 has been fairly general. It is understood that any variation in the structure of stove 10 can be used with the moveable baffle assembly of the present disclosure.

Figure 3:
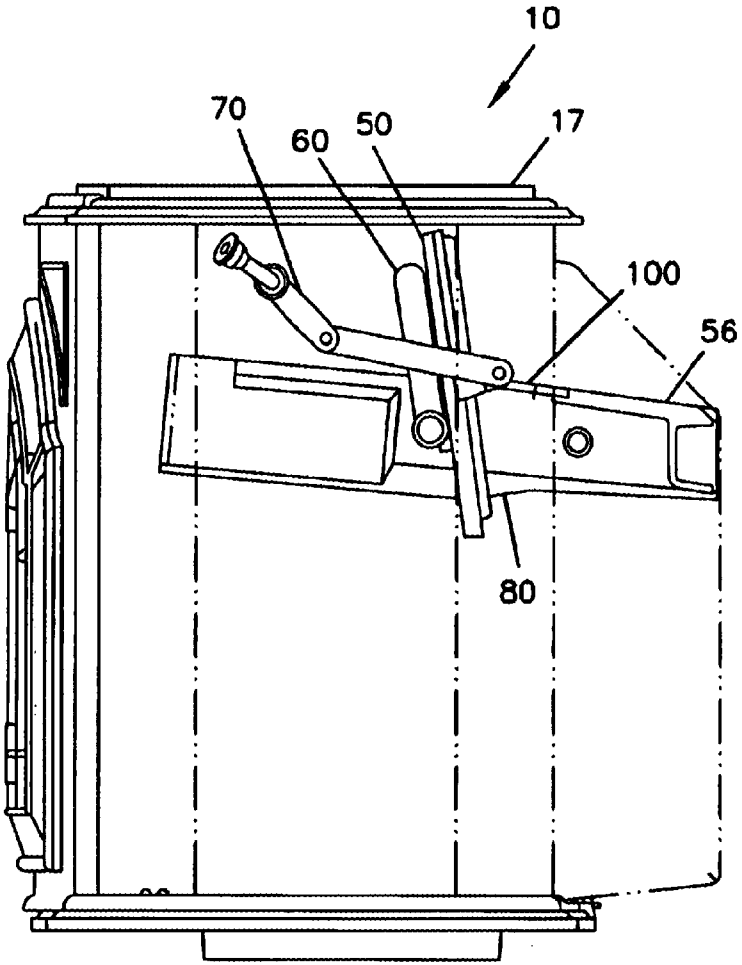
FIG. 3 is a side view of the stove of FIG. 2, illustrating the external stove structure and internal baffle assembly in an "open" configuration.
Figure 2:
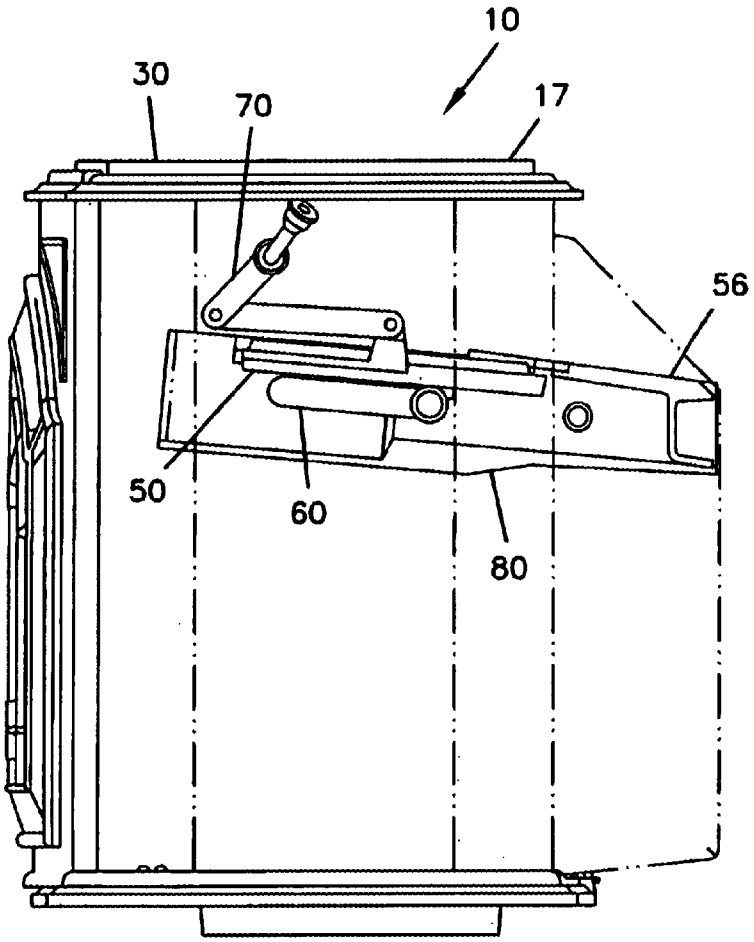
FIG. 2 is a side view of a first embodiment of the stove incorporating the principles of this disclosure, illustrating the external stove structure and internal baffle assembly in a "closed" configuration.
Figure 13:
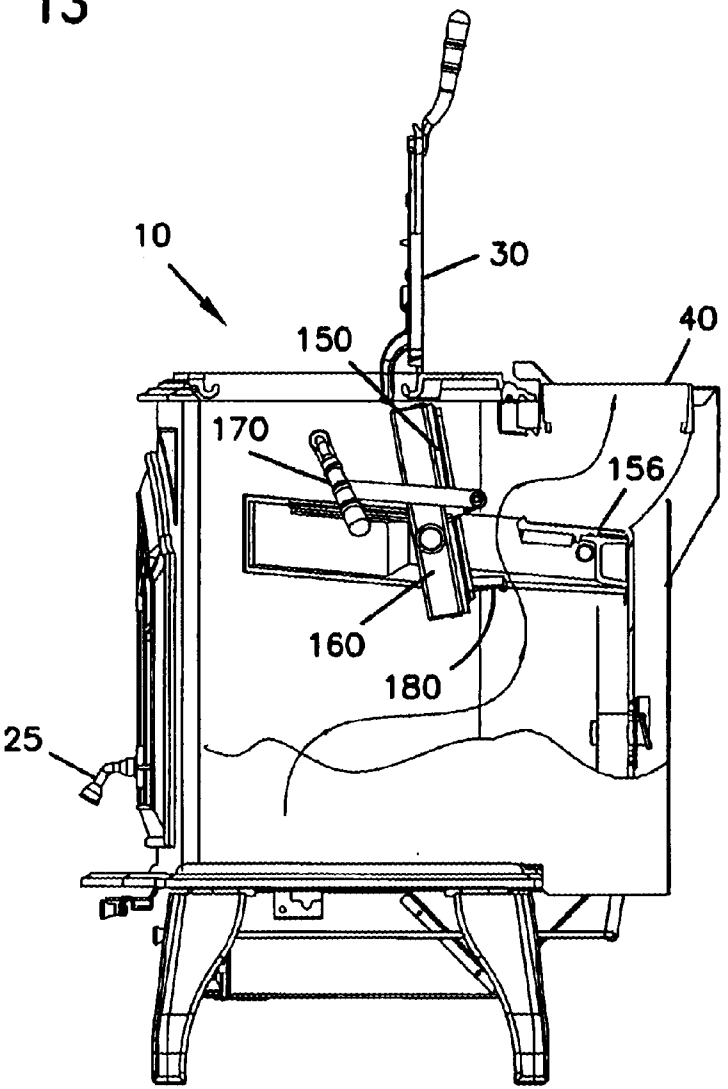
FIG. 13 is a side view of the stove of FIG. 12, illustrating the external stove structure and the internal baffle assembly in an "open" configuration.
Figure 12:
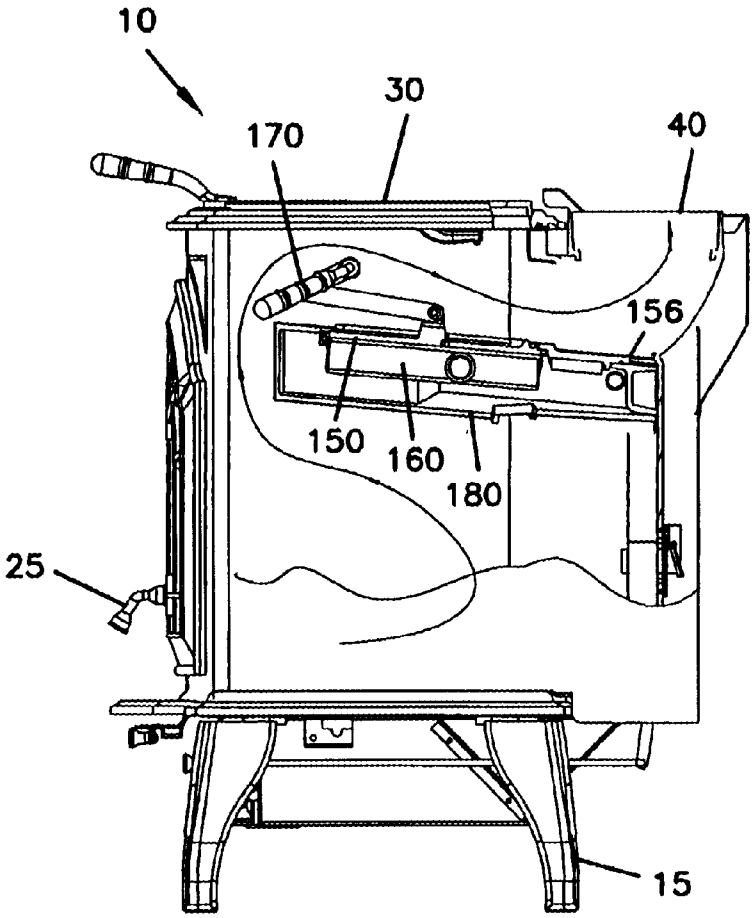
FIG. 12 is a cut-away side view of a second embodiment of the stove incorporating the principles of this disclosure, illustrating the external stove structure and internal baffle assembly in a "closed" configuration.
Figure 15:
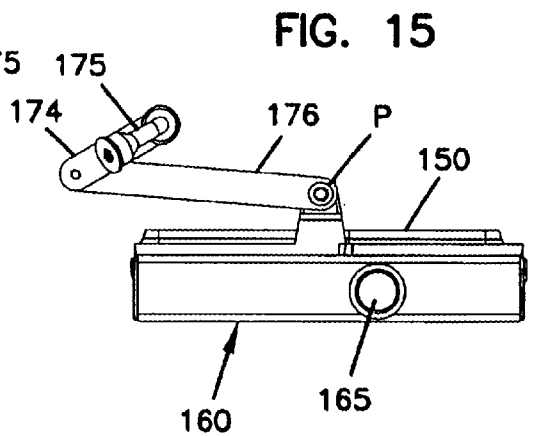
FIG. 15 is a side view of the portion of the baffle assembly shown in FIG. 14.
Figure 14:
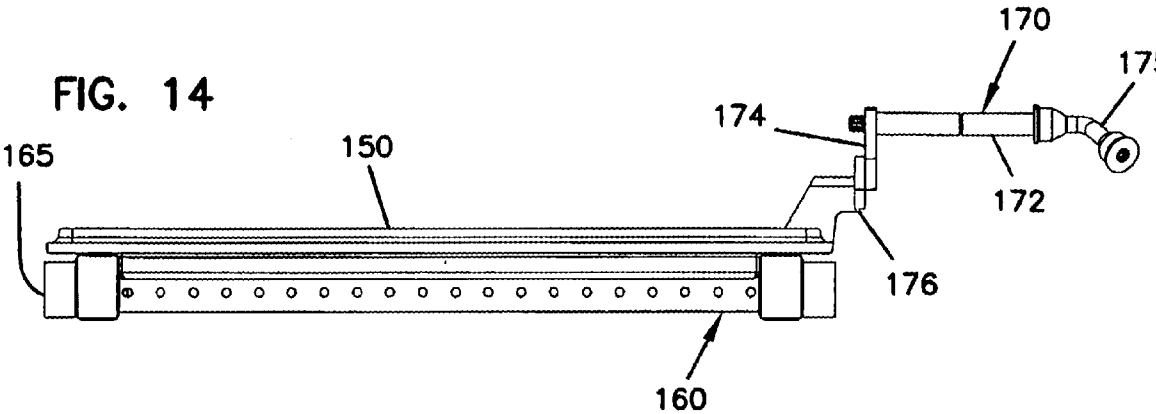
FIG. 14 is a front view of a portion of the baffle assembly shown in FIG. 12.
Figure 17:
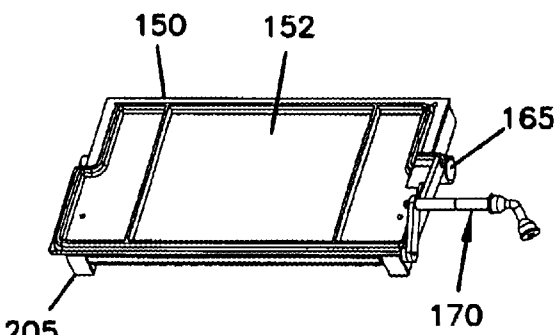
FIG. 17 is a perspective view of the portion of the baffle assembly shown in FIG. 14.
Figure 16:
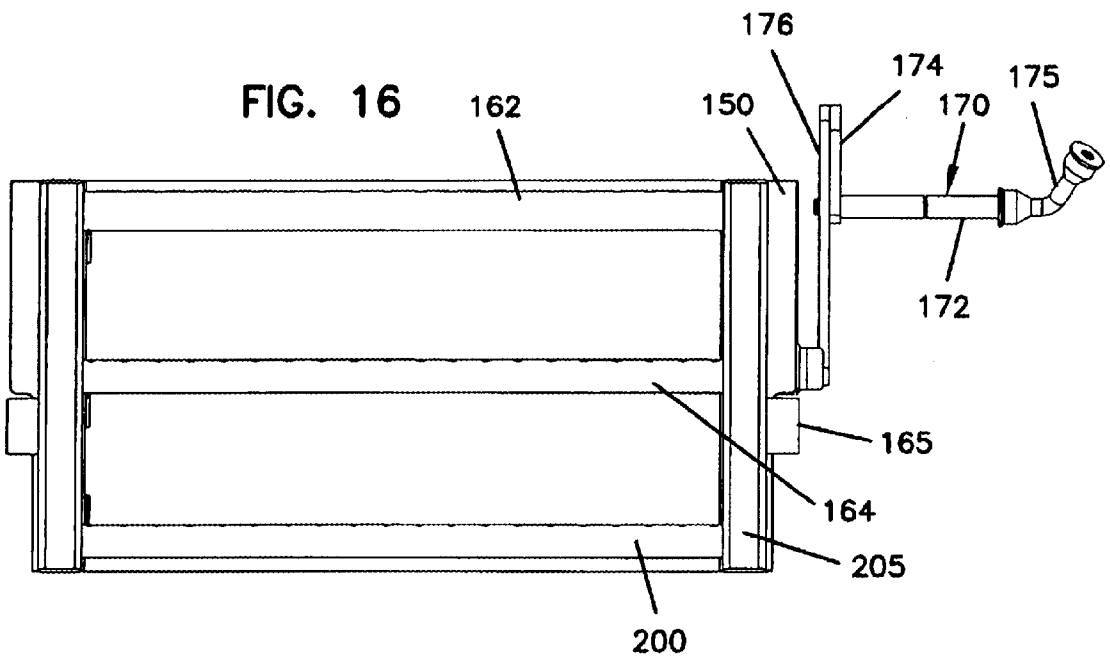
FIG. 16 is a bottom view of the portion of the baffle assembly shown in FIG. 14.

Stove 10, in accordance with the present disclosure, includes a handle 75 extending from body 12. Handle 75, which is part of a handle assembly, extends into the combustion chamber and is moveable as desired to manipulate the baffle assembly contained within the combustion chamber. The baffle assembly and its various elements will be now explained in detail, with reference to a first embodiment shown in FIGS. 2 and 3, and a second embodiment shown in FIGS. 12 and 13.

Referring now to FIGS. 2, 3, 12, and 13, stove 10 is shown in side view with the baffle assembly of the present disclosure viewable through the stove body. The baffle assembly of the present disclosure generally includes a baffle plate 50, 150, an air manifold 60, 160, and mounting members 80, 180 fixed to the combustion chamber side of the side walls. A handle assembly 70, 170 is provided to facilitate moving baffle plate 50, 150. A fixed baffle plate 56, 156 is also included in the baffle assembly shown.

Figure 4:
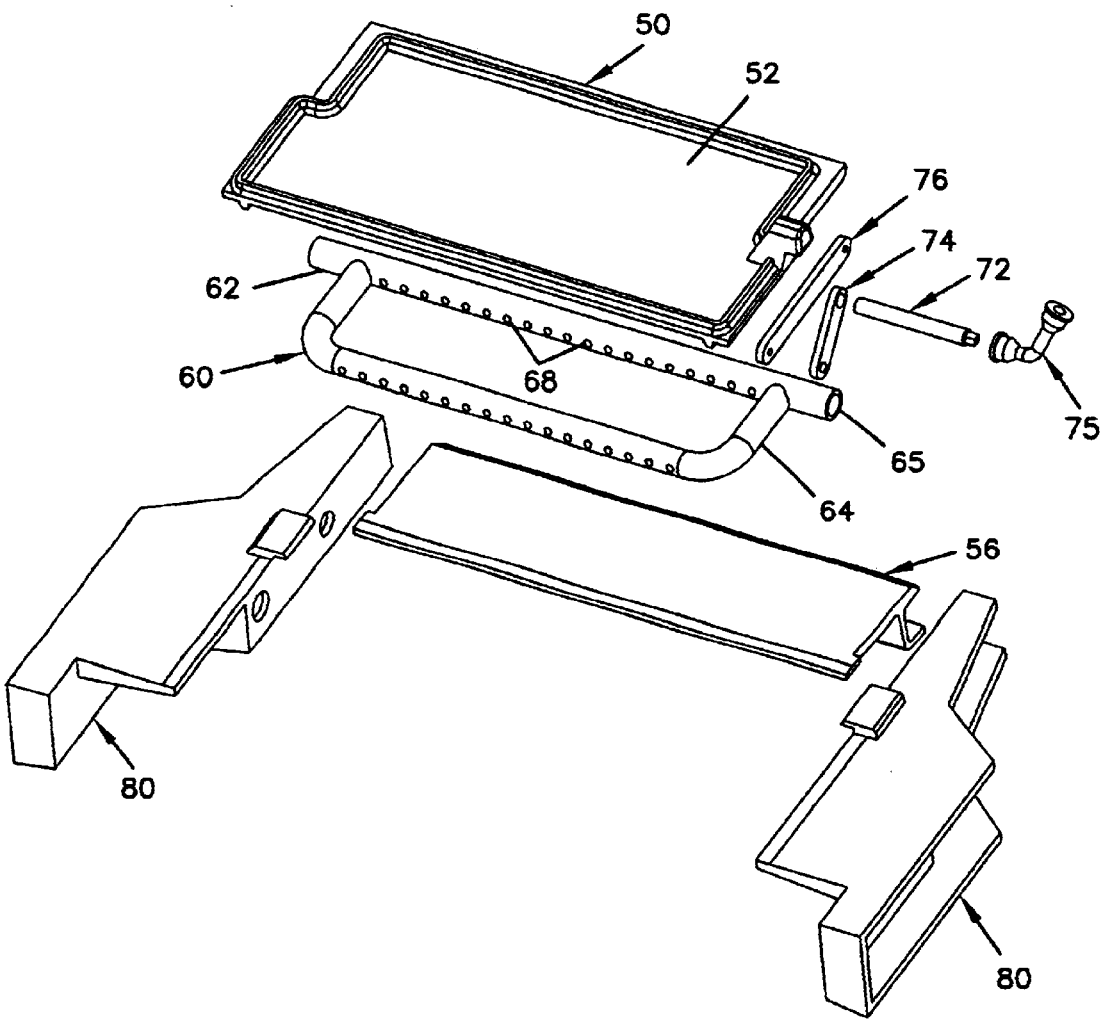
FIG. 4 is an exploded schematic view of the baffle assembly shown in FIGS. 2 and 3.

FIGS. 4 through 7 show various elements of a first embodiment of the baffle assembly. In FIG. 4, the various elements are shown in exploded view; in FIGS. 5 through 7, a portion of the baffle assembly is shown. In particular, in accordance with the present disclosure and shown in each of FIGS. 4 through 7, a moveable baffle plate 50 is provided. Baffle plate 50 has a generally planar, solid face 52. Various strengthening features, such as ribs and the like, may be included in or on baffle plate 50. A fixed baffle plate 56, shown in FIG. 4, is also provided in the baffle assembly. Fixed baffle plate 56 is fixed to the combustion chamber side of the back wall of the stove 10. Baffle plates 50, 56 are typically made from a sheet of metal, such as steel or cast iron, although other materials, such as ceramic materials, can be used.

Disposed proximate to baffle plate 50 is an air manifold 60 for providing and further manipulating air flow within the combustion chamber. The air manifold creates a secondary combustion area beneath the baffle plate and above the primary combustion area. Both the primary and secondary combustion areas are located in the combustion chamber. Air manifold 60 includes a first manifold section 62 and a second manifold section 64. In particular, first manifold section 62 is shown as an axial structure about which the manifold 60 can be pivoted, and second manifold section 64 is a D-shaped structure extending out from first section 62. Manifold sections 62, 64 are tubular structures that allow air flow there through. Air enters manifold 60 via intake 65 and exits manifold sections 62, 64 through apertures 68 disposed within manifold sections 62, 64. Preferably, a portion of air manifold 60, specifically a portion having intake 65, is in air flow communication with the exterior of the stove body 12. In one embodiment, intake 65 is connected to channels within the mounting members 80 that are connected to the exterior of the stove 10. These channels may meet the exterior at the stove sides, stove back, or at other locations.

Baffle plate 50 is connected to second manifold section 64 at connection point 54 and to first manifold section 62 at connection point 55. Together, baffle plate 50, air manifold 60, and fixed baffle plate 56 manipulate the air and smoke flow within the combustion chamber of stove 10 so that optimum temperature and combustion are realized therein.

Mounting members 80 are positioned adjacent to, and typically attached to, the combustion chamber side of the side walls. Mounting members 80 provide a seat or support against which the baffle plate 50 can rest when baffle plate 50 is in the "closed" position. Mounting members 80 may manipulate the air flow patterns somewhat. At least a portion of the mounting members 80 typically extends into the combustion chamber some distance from the wall on which it is attached.

Although mounting members 80 are shown as two oppositely placed pieces (see FIG. 4), mounting member 80 can be a single structure positioned on only one side wall 14 of 16, or on the front wall 18, or on the back wall. Alternately, mounting member 80 can be a single structure that is positioned on two or more walls. Further, in some embodiments it may be desirable to incorporate fixed baffle plate 56 with mounting member 80, thus having one structure that provides the desired air flow pattern and supports the moveable baffle plate 50.

The baffle assembly further includes a handle assembly 70 constructed to connect to, and move, baffle plate 50 and manifold 60 from the "open" to the "closed" configuration. Handle assembly 70 has a first position and a second position; when in the first position, the baffle plate 50 is in its "open" configuration, and when in the second position, the baffle plate 50 is in its "closed" configuration.

Handle assembly 70 includes a first section 72, second section 74, and third section 76, which are connected together and to baffle plate 50. A handle 75 is connected to first section 72 and is disposed on the exterior of stove 10 so that a consumer can grab and move handle 75 as desired. Although shown with three sections 72, 74, 76, it is understood that any handle assembly 70 configuration can be used to move baffle plate 50.

When the baffle assembly is disposed within the stove, baffle plate 50 is moveable, preferably pivotable, from an "closed" configuration to an "open" configuration. Baffle plate 50 and air manifold 60 are mounted within stove 10 in any manner to allow the desired movement from the "closed" configuration to the "open" configuration. In one embodiment, air manifold 60 is pivotally attached to mounting members 80, for example, in close proximity to intake 65. In such an attachment design, first manifold section 62 is an axis for rotation, or pivoting, of manifold 60. Because baffle plate 50 is attached to manifold 60 at points 54, 55, baffle plate 50 will move in congruence with manifold 60. In another embodiment, the pivoting of baffle plate 50 and manifold 60 are fixedly attached to handle assembly 70; this point of attachment is the pivot point. See for example, FIG. 7, in which reference numeral P designates a potential pivot point.

Figure 18:
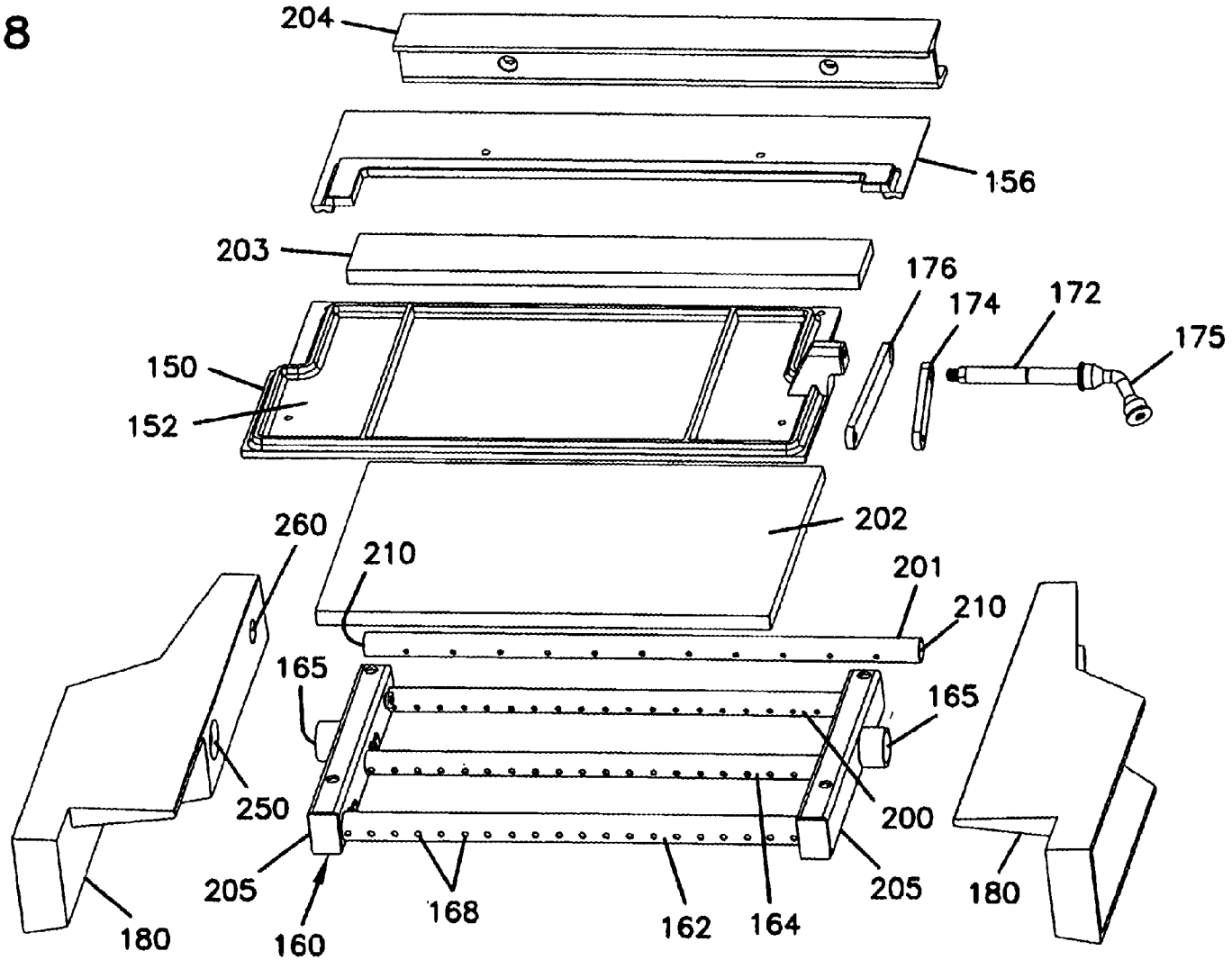
FIG. 18 is an exploded schematic view of the baffle assembly shown in FIGS. 14 and 17.

FIGS. 14 through 18 show various elements of a second embodiment of the baffle assembly, in which the air manifold is expanded. In FIG. 18, the various elements are shown in exploded view; in FIGS. 14 through 17, a portion of the baffle assembly is shown. In particular, in accordance with the present disclosure and shown in each of FIGS. 14 through 18, a moveable baffle plate 150 is provided. Baffle plate 150 has a generally planar, solid face 152. Various strengthening features, such as ribs and the like, may be included in or on baffle plate 150. A fixed baffle plate 156, shown in FIG. 18, is also provided in the baffle assembly. As shown in FIG. 18, fixed baffle plate 156 is fixed to the combustion chamber side of the back and/or side walls of the stove 10 via rear mounting member 204. It is to be understood that fixed baffle plate 156 can alternatively be fixed to the rear portion of the mounting members 180. Baffle plates 150, 156 are typically made from a sheet of metal, such as steel or cast iron, although other materials, such as ceramic materials, can be used for baffle plates 150, 156.

Disposed proximate to baffle plate 150 is an air manifold 160 for providing and further manipulating air flow within the combustion chamber. The air manifold creates a secondary combustion area beneath the baffle plate and above the primary combustion area within the combustion chamber. Air manifold 160 includes a first manifold section 162, a second manifold section 164, a third manifold section 200, and a fourth manifold section 201. In the illustrated embodiment, first, second, and third manifold sections 162, 164, 200 are shown as tubular structures connected to end pieces 205 about which the first, second, and third manifold sections 162, 164, 200 can be pivoted. A fourth, fixed, manifold section 201 is a tubular structure extending between, and fixed to, mounting members 180. Manifold sections 162, 164, 200, 201 are tubular structures that allow air flow there through. Air enters manifold 160 via intake 165 and exits manifold sections 162, 164, 200 through apertures 168 disposed within manifold sections 162, 164, 200. Air enters fourth manifold section 201 via intake 210 and exits through apertures 168 disposed within fourth manifold section 201. Preferably, a portion of air manifold 160, specifically a portion having intake 165, is in air flow communication with the exterior of the stove body 12. Additional intake 210 is in air flow communication with the fourth tubular section 201 and with the exterior of the stove body 12. In one embodiment, intakes 165, 210 are connected to channels 250, 260, respectively, within mounting members 180 that are connected to the exterior of the stove 10. These channels may be joined together under mounting members 180 and exit through the wall of the stove as a single channel, or they may exit separately. These channels may meet the exterior at the stove sides, stove back, or at other locations.

Baffle plate 150 is connected to end pieces 205. Together, baffle plate 150, air manifold 160, and fixed baffle plate 156 manipulate the air and gas flow within the combustion chamber of stove 10 to create a secondary combustion area above the primary combustion area so that optimum temperature and combustion are realized in the stove. In one embodiment, insulation panels 202, 203 are included in the baffle assembly. Insulation panels 202, 203 are constructed of insulating material to reflect heat back into the combustion chamber from the baffle assembly and thereby maximize the temperature within the combustion chamber during all burn conditions, and thereby encouraging secondary and tertiary combustion above the fuel bed. In a further embodiment, the insulation panels 202, 203 may also provide structural support for the baffle plates 150, 156. The insulation panels 202, 203 may be made of any suitable insulating material. In one embodiment, the insulation panels 202, 203 are ceramic.

Mounting members 180 are positioned adjacent to, and typically attached to, the combustion chamber side of the side walls. Mounting members 180 provide a seat or support against which the baffle plate 150 can rest when baffle plate 150 is in the "closed" position. Mounting members 180 may manipulate the air flow patterns somewhat. At least a portion of mounting members 180 typically extends into the combustion chamber some distance from the wall on which it is attached.

Although mounting members 180 are shown as two oppositely placed pieces (see FIG. 18), mounting members 80 can be a single structure positioned on only one side wall 14 of 16, or on the front wall 18, or on the back wall. Alternately, mounting members 180 can be a single structure that is positioned on two or more walls. Further, in some embodiments it may be desirable to incorporate fixed baffle plate 156 with mounting members 180, thus having one structure that provides the desired air flow pattern and supports the moveable baffle plate 150.

The baffle assembly further includes a handle assembly 170 constructed to connect to, and move, baffle plate 150 and manifold 160 from the "open" to the "closed" configuration. Handle assembly 170 has a first position and a second position; when in the first position, the baffle plate 150 is in its "open" configuration, and when in the second position, the baffle plate 150 is in its "closed" configuration.

Handle assembly 170 includes a first section 172, second section 174, and third section 176, which are connected together and to baffle plate 150. A handle 175 is connected to first section 172 and is disposed on the exterior of stove 10 so that a consumer can grab and move handle 175 as desired. Although shown with three sections 172, 174, 176, it is understood that any handle assembly 170 configuration can be used to move baffle plate 150.

When the baffle assembly is disposed within the stove, baffle plate 150 is moveable, preferably pivotable, from an "closed" configuration to an "open" configuration. Baffle plate 150 and air manifold 160 are mounted within stove 10 in any manner to allow the desired movement from the "closed" configuration to the "open" configuration. In one embodiment, air manifold 160 is pivotally attached to mounting members 180 through end pieces 205, for example, in close proximity to intake 165. In such an attachment design, the end pieces 205 provide an axis for rotation, or pivoting, of manifold 160. Because baffle plate 150 is attached to manifold 160, baffle plate 150 will move in congruence with manifold 160. In another embodiment, the pivoting of baffle plate 150 and manifold 160 are fixedly attached to handle assembly 170; this point of attachment is the pivot point. See for example, FIG. 15, in which reference numeral P designates a potential pivot point.

Figure 8:
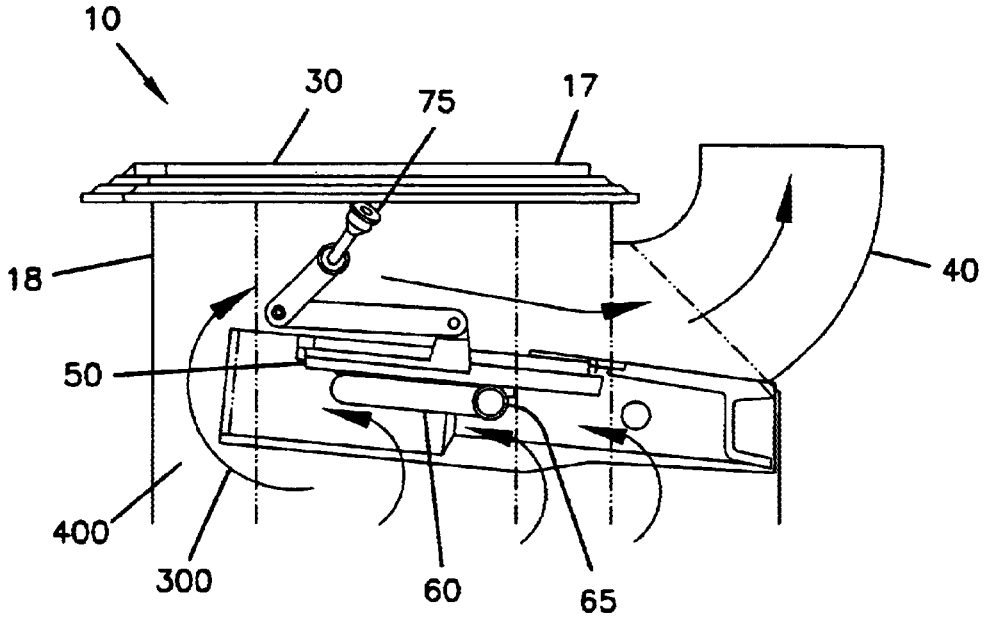
FIG. 8 is a partial side view of the stove of FIG. 2, illustrating the direction of air flow around the baffle assembly in a "closed" configuration.
Figure 9:
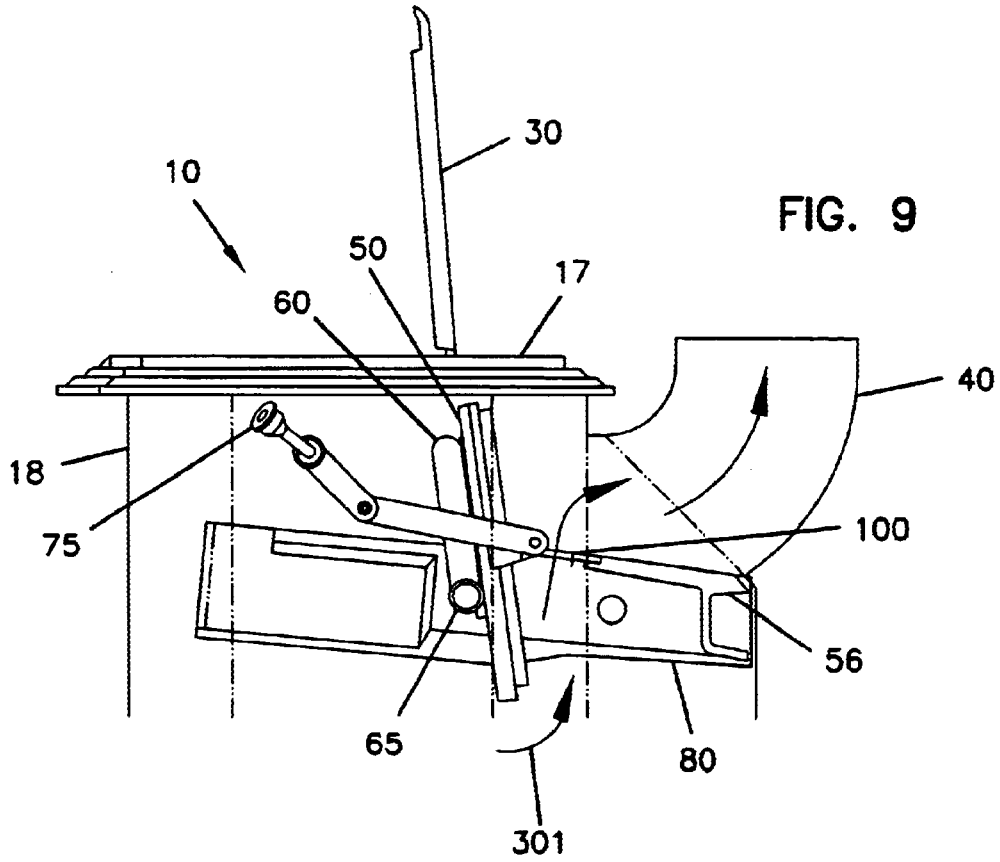
FIG. 9 is a partial side view of the stove of FIG. 3, illustrating the direction of air flow by-passing the baffle assembly in an "open" configuration.

Referring to FIGS. 8 and 9, partial side views of stove 10 are shown with the baffle plate 50 in the "closed" and "open" configurations, respectively. The pivot point for these embodiments is intake 65. In both FIGS. 8 and 9, the air flow pattern, mostly the flow pattern of smoke and combustion gases, is depicted by the arrows 300, 301.

In FIG. 8, the baffle plate 50 is in the "closed" configuration with baffle plate 50 seated against mounting members 80. In this configuration, the baffle plate 50 is spaced apart from at least a portion of the front wall 18 forming a passage 400 from the combustion chamber to the chimney 40. The passage 400 may be formed in any location where the baffle plate is spaced apart from at least a portion of a side wall. Handle 75 is in a first position. Baffle plate 50, and air manifold 60, are substantially horizontal. Smoke and gases rise from the burning wood, (not shown, but which is typically on the base wall of the stove), and is directed by baffle plate 50 toward front wall 18. The smoke and gases flow generally parallel to baffle plate 50. The smoke and gases then pass through the passage 400, around and over baffle plate 50 and mounting members 80, and flow out chimney 40, as indicated by arrow 300.

In FIG. 9, handle 75 is in a second position and the baffle plate 50 is in the "open" configuration with baffle plate 50 not seated against mounting members 80; baffle plate 50 is displaced from its seat on mounting members 80 and a by-pass pathway 100, separate from passage 400, is opened. In the position shown, baffle plate 50 and air manifold 60 are substantially vertical, and the by-pass pathway 100 is formed between the "open" baffle plate 50 and the fixed baffle 56. With baffle plate 50 pivoted to the "open" position, smoke and gases are able to move through by-pass pathway 100, as indicated by arrow 301. The smoke and gases flow generally parallel to baffle plate 50 through by-pass pathway 100. In FIG. 9, stove 10 is also shown with door 30 opened to provide access from the exterior to the interior of stove 10.

Figure 11:
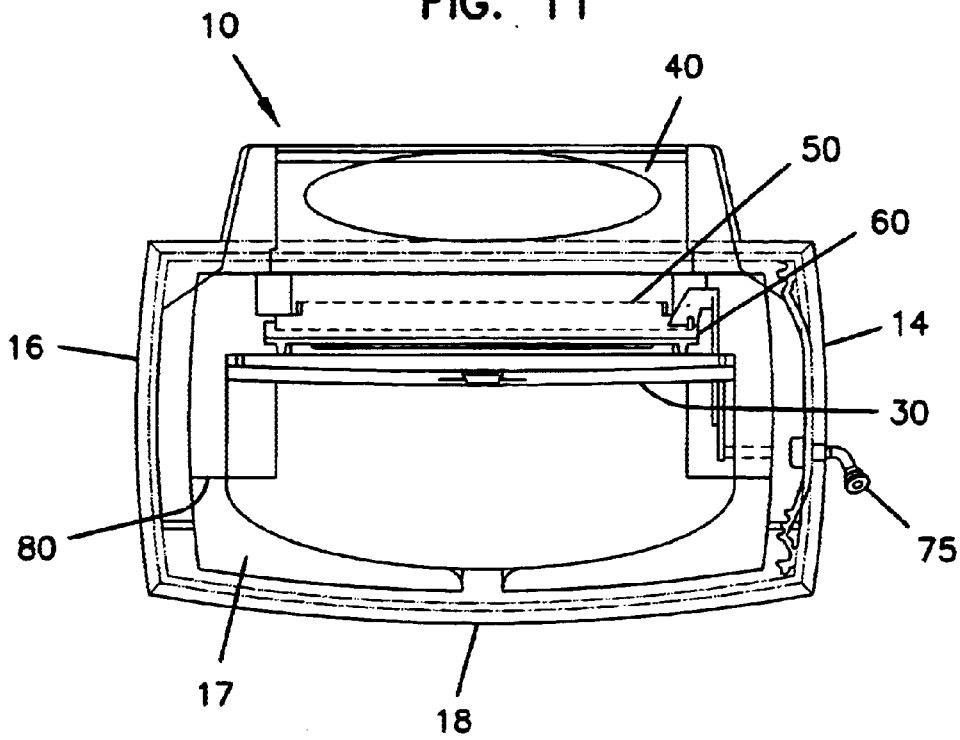
FIG. 11 is a top view of the stove of FIG. 3, with the top access door open and the baffle assembly in the "open" configuration.
Figure 10:
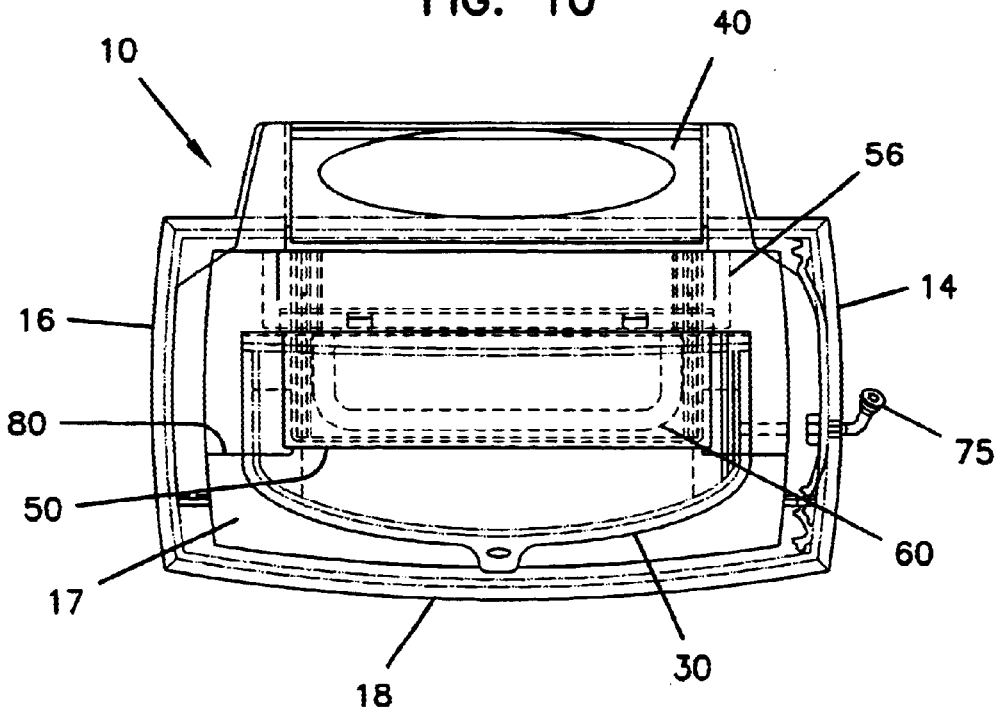
FIG. 10 is a top view of the stove of FIG. 2, with the baffle assembly in the "closed" configuration.

FIGS. 10 and 11 show schematic top views of stove 10. In FIG. 10, door 30 is closed, and baffle plate 50 and manifold 60 are in the "closed" configuration; in FIG. 11, door 30 is open, and baffle plate 50 and manifold 60 are in the "open" configuration. It can be seen that when in the "open" configuration, access into the combustion chamber of stove 10 is generally unobstructed.

Fuel, such as wood, can be loaded into stove 10 by various methods. In one embodiment, first door 20 can be pivoted on hinges 22 to open an access port to the combustion chamber. Prior to opening door 20, handle 75 is optionally moved from its first position to its second position, thereby moving baffle plate 50 from the "closed" configuration to the "open" configuration. Moving baffle plate 50 to the "open" configuration will open a by-pass channel 100 to allow smoke and gases to pass from the combustion chamber, through by-pass channel 100, out chimney 40. In this embodiment, baffle plate 50 minimizes the amount of smoke that might exit through door 20 when door 20 is opened.

In another embodiment, fuel is loaded through the second door 30, located in top wall 17. Handle 75 is moved from its first position to its second position, thereby moving baffle plate 50 from the "closed" configuration to the "open" configuration. Moving baffle plate 50 to the "open" configuration will open by-pass channel 100 to allow smoke and gases to pass from the combustion chamber, through by-pass channel 100, and out chimney 40. Further, moving baffle plate 50 to the "open" configuration will provide a generally unobstructed access to the interior so that wood can be lowered into the combustion chamber through door 30 in top wall 17. In this embodiment, baffle plate 50 not only minimizes the amount of smoke that might exit through door 30 when door 30 is opened, but the pivotable baffle plate 50 provides an area through which wood can be easily passed for top loading.

The above specification has been provided to illustrate specific examples of embodiments incorporating the principles of this disclosure. Those skilled in the art will readily recognize other applications and configurations that fall within the scope of this disclosure. Since many embodiments of the disclosure can be made without departing from the spirit and scope of the disclosure, the disclosure resides in the claims hereinafter appended.

We claim:

1. A stove comprising:

(a) a stove body defining a combustion chamber therein, the stove body comprising a top wall, a bottom wall, and at least one side wall, the top wall having an access door therein;

(b) a chimney in air flow communication with the combustion chamber; and (c) a baffle plate disposed within the combustion chamber, the baffle plate moveable from a closed configuration to an open configuration, wherein:

(i) when in the closed configuration, the baffle plate is positioned substantially horizontally within the combustion chamber and is spaced apart from at least a portion of the at least one side wall; and (ii) when in the open configuration, the baffle plate is positioned substantially vertically such that a pathway is created between the access door and the combustion chamber for loading fuel.

2. The stove according to claim 1, further comprising an air manifold, the air manifold positioned below the baffle plate and in air flow communication with an air source exterior to the stove, wherein the air manifold is constructed and arranged to provide air from the air source exterior to the stove to the combustion chamber.

3. The stove according to claim 2, wherein the air manifold is attached to the baffle plate.

4. The stove according to claim 3, wherein the air manifold comprises at least a first section.

5. The stove according to claim 4, wherein the first section is tubular and has apertures therethrough fur providing air flow communication from the air source exterior the stove, through the tabular section, and into the combustion chamber.

6. The stove according to claim 5, wherein the tubular section provides a pivot point for pivoting the baffle plate and air manifold.

7. The stove according to claim 5, wherein the air manifold further comprises a second tubular section having apertures therethrough, wherein the first and second tubular sections have lengths extending from a first end to a second end, the first and second sections are spaced apart along at least a part of their lengths, and are connected to each other.

8. The stove according to claim 7, wherein the first tubular section provides a pivot point for pivoting the baffle plate and air manifold.

9. The stove according to claim 7, wherein the air manifold further comprises a third tubular section having apertures therethrough, the third tubular section having a length extending from a first end to a second end, the third section spaced apart and substantially parallel to the first and second sections, the first, second, and third section connected to each other through end pieces.

10. The stove according to claim 9, wherein the end pieces provide a pivot point for pivoting the baffle plate and air manifold.

11. The stove according to claim 10, further comprising mounting members disposed within the stove body, the end pieces pivotally attached to the mounting members, wherein the air manifold comprises a fourth tubular section with apertures therethrough which is attached to the mounting members spaced apart from the first, second and third tubular sections, the fourth tabular section not attached to the baffle plate.

12. The stove according to claim 1, wherein the baffle plate is spaced apart from at least a portion of the at least one side wall forming a passage from the combustion chamber to the chimney, the baffle plate moveable from a closed configuration to an open configuration, wherein:

(i) when in the closed configuration, the baffle plate directs gases within the combustion chamber to flow from the combustion chamber, around the baffle plate, through the passage, and out the chimney; and (ii) when the baffle plate is in the open configuration, a by-pass pathway is formed, separate from the passage, between the combustion chamber and the chimney, so that gases within the combustion chamber flows from the combustion chamber, through the by-pass pathway, and out the chimney; the by-pass pathway not existing when the baffle plate is in the closed configuration.

13. A stove comprising:

(a) a stove body defining a combustion chamber therein, the stove body comprising a top wall, a bottom wall and at least one side wall, the ton wall having an access door therein;

(b) a chimney in air flow communication with the combustion chamber; and (c) a baffle plate disposed within the combustion chamber, the baffle plate spaced apart from at least a portion of the at least one side wall forming a passage from the combustion chamber to the chimney, the baffle plate moveable from a closed configuration to an open configuration, wherein:

(i) when in the closed configuration, the baffle plate directs gases within the combustion chamber to flow from the combustion chamber, around the baffle plate, through the passage, and out the chimney; and (ii) when the baffle plate is in the open configuration, a by-pass pathway is formed, separate from the passage, between the combustion chamber and the chimney, so that gases within the combustion chamber flows from the combustion chamber, through the by-pass pathway, and out the chimney;

the by-pass pathway now existing when the baffle plate is in the closed configuration.

14. The stove according to claim 13, further comprising another access door in one or more of the bottom or side walls.

15. The stove according to claim 13, further comprising an air manifold positioned below the baffle plate, the combination of the baffle plate and air manifold creating a secondary combustion area below the baffle plate, the air manifold in air flow communication with a second air supply system, the air manifold constructed and arranged to directing air from outside the stove into the secondary combustion area.

16. The stove according to claim 15, wherein the air manifold is attached to the baffle plate.

17. A stove comprising:

(a) a stove body defining a combustion chamber therein, the stove body comprising a top) wall having an access door therein;

(b) a first air supply system directing air from outside the stove into a first combustion area within the combustion chamber;

(c) a baffle plate assembly disposed within the combustion chamber, the baffle plate assembly moveable from a closed configuration to an open configuration, the baffle plate assembly defining a secondary combustion area below the baffle plate and above the primary combustion area, wherein the baffle plate assembly comprises:

(i) a baffle plate, and (ii) an air manifold positioned below the baffle plate, the air manifold in air flow communication with a second air supply system, the air manifold constructed and arranged to direct air from outside the stove into the secondary combustion area.

18. The stove according to claim 17, wherein the stove body further comprises a bottom wall and at least one side wall, the stove body having another access door in one or more of the bottom or side walls.

19. The stove according to claim 18, wherein the baffle plate is spaced apart from at least a portion of the at least one side wall forming a passage from the combustion chamber to the chimney, the baffle plate moveable from a closed configuration to an open configuration, wherein:

(i) when in the closed configuration, the baffle plate directs gases within the combustion chamber to flow from the combustion chamber, around the baffle plate, through the passage, and out the chimney; and (ii) when the baffle plate is in the open configuration, a by-pass pathway is formed, separate from the passage, between the combustion chamber and the chimney, so that gases within the combustion chamber flows from the combustion chamber, through the by-pass pathway, and out the chimney; the by-pass pathway not existing when the baffle plate is in the closed configuration.

20. A method of adding fuel to an existing fire in a stove utilizing primary and secondary combustion, the stove comprising:

(a) a stove body defining a combustion chamber therein, the stove body comprising a top wall, a bottom wall, and at least one side wall, the top wall having an access door therein;

(b) a chimney in air flow communication with the combustion chamber; and (c) a baffle plate disposed within the combustion chamber, the baffle plate spaced apart from at least a portion of the at least one side wall forming a passage from the combustion chamber to the chimney, the baffle plate moveable from a closed configuration to an open configuration far loading fuel, wherein:

(i) when in the closed configuration, the baffle plate directs gases within the combustion chamber to flow from the combustion chamber, around the baffle plate, through the passage, and out the chimney; and (ii) when the baffle plate is in the open configuration, a by-pass pathway is formed, separate from the passage, between the combustion chamber and the chimney, so that gases within the combustion chamber flow from the combustion chamber, through the by-pass pathway, and out the chimney; the by-pass pathway not existing when the baffle plate is in the closed configuration; the method comprising:

moving the baffle plate from the closed configuration the open configuration, thus drawing heat and gases from the fire out through the by-pass pathway into the chimney;

opening the access door;

loading fuel through the door passed the open baffle plate and into the combustion chamber;

moving the baffle plate into the closed configuration; and closing the access door.

* * * * *

UNITED STATES PATENT AND TRADEMARK OFFICE

CERTIFICATE OF CORRECTION

PATENT NO. : 6,688,302 B2
APPLICATION NO. : 09/809627
DATED : February 10, 2004
INVENTOR(S) : Daniel S. Henry et al.

It is certified that error appears in the above-identified patent and that said Letters Patent is hereby corrected as shown below:

Column 9

Line 14
Replace the word "fur" with the word -- for --

Line 16
Replace the word "tabular" with the word -- tubular --

Line 46
Replace the word "tabular" with the word -- tubular --

Line 67
Replace the word "ton" with the word -- top --

Column 10

Line 19
Replace the word "now" with the word -- not --

Line 36
Remove the ")" occurring after the word "top"

Column 11

Line 20
Replace the word "far" with the word -- for --

Signed and Sealed this
Fifteenth Day of May, 2012

David J. Kappos

David J. Kappos
*Director of the United States Patent and Trademark Office*

Column 12

Line 11
Add the word -- to -- after the word “configuration”

Line 16
Replace the word “passed” with the word -- past --